US009873059B1

(12) United States Patent
Sutton

(10) Patent No.: US 9,873,059 B1
(45) Date of Patent: Jan. 23, 2018

(54) CONVERTIBLE TOY

(71) Applicant: Jay At Play International Hong Kong Limited, Kowloon (HK)

(72) Inventor: Joseph A. Sutton, West New York, NJ (US)

(73) Assignee: JAY AT PLAY INTERNATIONAL HONG KONG LIMITED, Kowloon (HK)

( * ) Notice: Subject to any disclaimer, the term of this patent is extended or adjusted under 35 U.S.C. 154(b) by 0 days.

(21) Appl. No.: 15/614,930

(22) Filed: Jun. 6, 2017

Related U.S. Application Data

(60) Provisional application No. 62/469,926, filed on Mar. 10, 2017.

(51) Int. Cl.
*A63H 3/12* (2006.01)
*A63H 33/00* (2006.01)
*A63H 9/00* (2006.01)

(52) U.S. Cl.
CPC ..... *A63H 33/003* (2013.01); *A63H 9/00* (2013.01); *A63H 33/00* (2013.01)

(58) Field of Classification Search
None
See application file for complete search history.

(56) References Cited

U.S. PATENT DOCUMENTS

D39,135 S * 2/1908 Keilman ..... D11/47
1,138,412 A 5/1915 Radick
1,148,540 A 8/1915 Sancier
1,322,713 A * 11/1919 Marshall ..... A63H 3/16 446/100
1,396,766 A 11/1921 McClelland
1,966,986 A 7/1934 Martin
2,195,127 A * 3/1940 Brucker ..... A63H 3/12 446/321
D123,710 S * 11/1940 Berenzweig ..... D11/41
2,274,303 A * 2/1942 Ornstein ..... A63H 3/16 446/369

(Continued)

FOREIGN PATENT DOCUMENTS

GB 1112375 5/1968
GB 2458838 10/2009

(Continued)

OTHER PUBLICATIONS

Pufferbelly Toys, "Kinder Surprise Toys Natoons Series Animal Shifters 2014-2015-SurpriseEggsSHOW" available online as early as Mar. 5, 2017 (http://www.pufferbellytoys.com/kinder-surprise-toys-natoons-series-animal-shifters-2014-2015-surpriseeggsshow/ ).

(Continued)

*Primary Examiner* — Aarti B Berdichevsky
*Assistant Examiner* — Urszula M Cegielnik
(74) *Attorney, Agent, or Firm* — Michael Best & Friedrich LLP

(57) ABSTRACT

A toy includes a first head of a rigid material and a second head of a rigid material coupled to the first head and facing in an opposite direction to the first head. A flexible flap intervenes between the first and second heads and is movable from a first position, in which the flap covers the second head with the first head exposed to view, to a second position, in which the flap covers the first head with the second head exposed to view.

19 Claims, 5 Drawing Sheets

(56) References Cited

U.S. PATENT DOCUMENTS

| | | | | | |
|---|---|---|---|---|---|
| 2,314,223 | A * | 3/1943 | Lane | A44C 1/00 | 24/129 R |
| D135,970 | S * | 7/1943 | Katz | D11/41 | |
| D137,682 | S * | 4/1944 | Katz | D11/41 | |
| D141,120 | S * | 5/1945 | Katz | D11/41 | |
| D141,346 | S * | 5/1945 | Katz | D11/41 | |
| D142,483 | S * | 10/1945 | Katz | D11/41 | |
| D146,032 | S * | 12/1946 | Katz | D11/41 | |
| D147,666 | S * | 10/1947 | Katz | D11/41 | |
| D155,050 | S * | 8/1949 | Vaisey | D11/205 | |
| D179,740 | S * | 2/1957 | Nagel | D11/205 | |
| 3,737,196 | A * | 6/1973 | Bodor | A63H 3/02 | 297/181 |
| 3,831,316 | A * | 8/1974 | Weistrop | A63H 3/003 | 446/321 |
| 3,851,419 | A | 12/1974 | Kaelin | | |
| 4,107,873 | A | 8/1978 | Bauer | | |
| 4,198,733 | A * | 4/1980 | Ferguson | A44B 1/12 | 24/113 R |
| 4,268,918 | A * | 5/1981 | Lee | A42B 1/004 | 2/172 |
| 4,336,665 | A | 6/1982 | Moreau | | |
| D267,313 | S * | 12/1982 | Northcutt, III | D11/1 | |
| D269,862 | S * | 7/1983 | Meyer | D11/50 | |
| 4,568,304 | A * | 2/1986 | Santa Maria | A63H 3/12 | 446/321 |
| 4,580,992 | A | 4/1986 | McKay | | |
| 4,695,264 | A * | 9/1987 | McLeod, Jr. | A63H 3/12 | 446/321 |
| 4,842,565 | A | 6/1989 | VonPhilp, Sr. | | |
| 4,921,459 | A * | 5/1990 | Cook | A63H 3/12 | 446/321 |
| 5,080,518 | A * | 1/1992 | Mason | A44C 7/00 | 428/16 |
| 5,090,935 | A * | 2/1992 | Monson | A63F 9/12 | 273/157 R |
| 5,149,289 | A | 9/1992 | Edwards et al. | | |
| 5,162,013 | A | 11/1992 | von Mohr | | |
| 5,348,510 | A * | 9/1994 | DuPont | A42B 1/004 | 2/209.12 |
| 5,649,848 | A | 7/1997 | Clark | | |
| 6,174,216 | B1 * | 1/2001 | Chianese | A63H 3/02 | 446/320 |
| 8,375,469 | B2 * | 2/2013 | Duwyn-Zylstra | A42B 1/206 | 2/175.1 |
| 8,506,344 | B2 | 8/2013 | Chan et al. | | |
| 2004/0026468 | A1 * | 2/2004 | Lawrence | A42C 5/00 | 223/16 |
| 2005/0039345 | A1 * | 2/2005 | Jones | A43B 1/0027 | 36/11.5 |
| 2008/0155788 | A1 * | 7/2008 | Wilcox | A43B 3/0078 | 24/3.1 |
| 2010/0181032 | A1 * | 7/2010 | Bennett | A47H 2/00 | 160/330 |
| 2013/0019380 | A1 * | 1/2013 | Sitt | A42B 1/24 | 2/209.13 |
| 2017/0136375 | A1 * | 5/2017 | Narayanan | A63H 3/04 | |

FOREIGN PATENT DOCUMENTS

| | | |
|---|---|---|
| WO | 93/05857 | 4/1993 |
| WO | 00/64551 | 11/2000 |
| WO | 2006/100419 | 9/2006 |

OTHER PUBLICATIONS

Wanelo, "Topsy Turvy Dolls" available online at least as early as Mar. 5, 2017 (https://wanelo.co/shop/topsy-turvy-dolls).

As Seen on TV, "Pop Out Pets Dogs" available online at least as early as Sep. 5, 2015 (http://www.asseenontv.com/pop-out-pets-dogs/detail.php?p=863930).

* cited by examiner

CONVERTIBLE TOY

RELATED APPLICATIONS

This application claims the benefit of U.S. Provisional Patent Application No. 62/469,926 filed on Mar. 10, 2017, the entire content of which is hereby incorporated herein by reference.

BACKGROUND

The present invention relates to toys.

SUMMARY

In one aspect, the invention provides a toy including a first head of a rigid material and a second head of a rigid material coupled to the first head and facing in an opposite direction to the first head. A flexible flap intervenes between the first and second heads and is movable from a first position, in which the flap covers the second head with the first head exposed to view, to a second position, in which the flap covers the first head with the second head exposed to view.

In another aspect, the invention provides a toy including a first head of a rigid material, a second head of a rigid material coupled to the first head and facing in an opposite direction to the first head, a flexible flap sandwiched between the first and second heads and movable from a first position, in which the flap covers the second head with the first head exposed to view, to a second position, in which the flap covers the first head with the second head exposed to view, and a post that couples the first and second heads together. The flexible flap includes an aperture and the post extends through the aperture.

Other aspects of the invention will become apparent by consideration of the detailed description and accompanying drawings.

DETAILED DESCRIPTION

Figure 1:
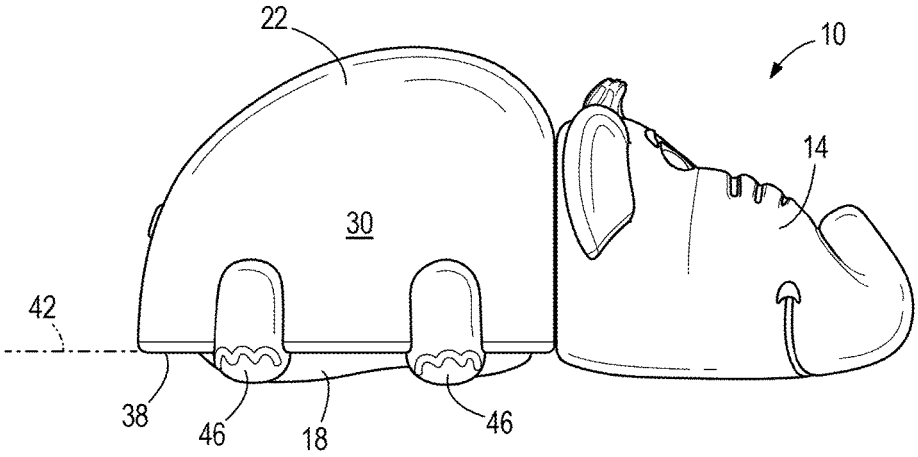
FIG. 1 is a side view of a toy embodying the present invention in a first configuration.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-4 illustrate a first embodiment of a toy 10 according to the present invention. The toy 10 is convertible between two different configurations so that children can enjoy two different characters or creatures with a single toy. The toy 10 can be marketed as a collectible toy, with numerous character options. The illustrated toy 10 includes a first head 14 of a rigid material (e.g., PVC or other suitable rigid materials), a second head 18 of a rigid material coupled to the first head 14 and facing in an opposite direction to the first head 14, and a flexible flap 22 intervening between or sandwiched between the first and second heads 14, 18. As used herein and in the appended claims, the term "head" can include a representation of a character or creature or animal head, but can also include various other objects, forms, and configurations that might be used as opposing distal ends of the toy 10. In some other embodiments, the heads could alternatively be made of non-rigid materials, such as plush materials or fabrics, or could include combinations of rigid portions and plush portions.

Figure 5:
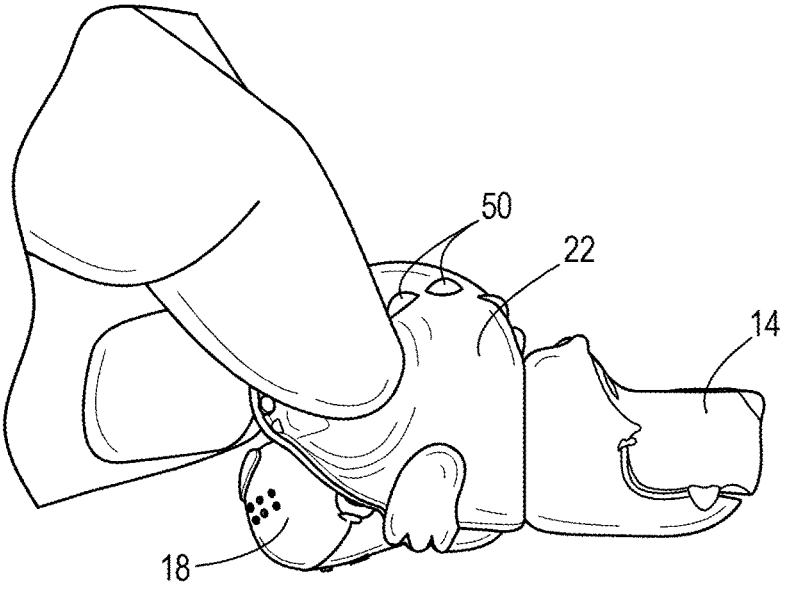
FIGS. 5-7 illustrate another embodiment of the toy showing the transformation between first and second configurations.
Figure 6:
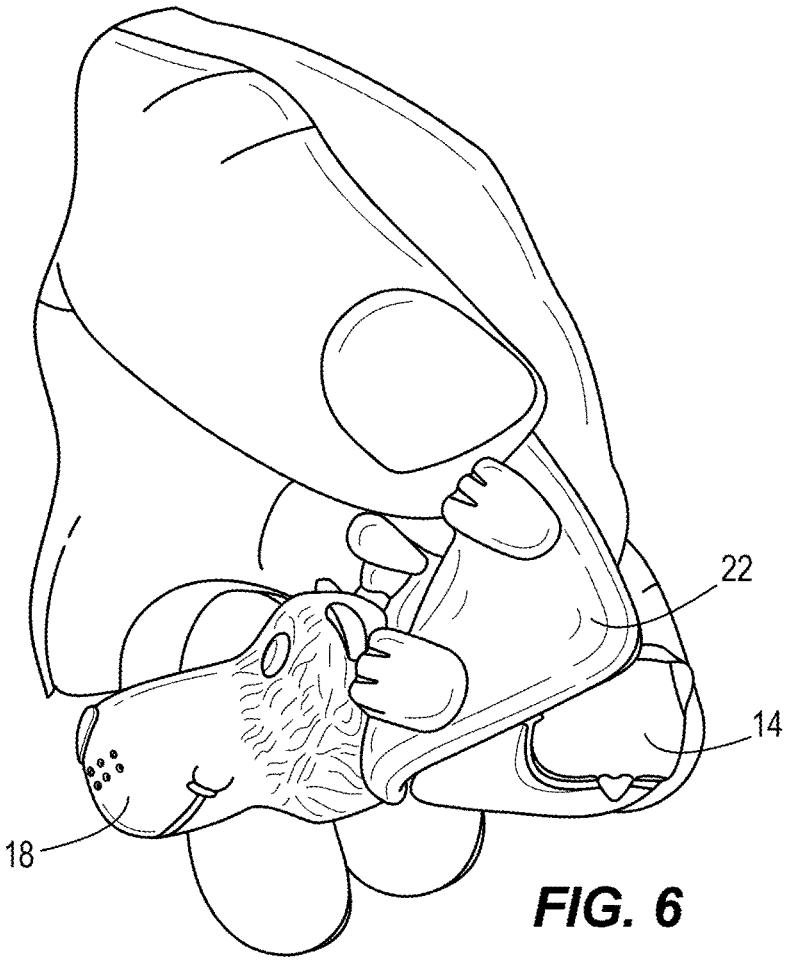
Figure 7:
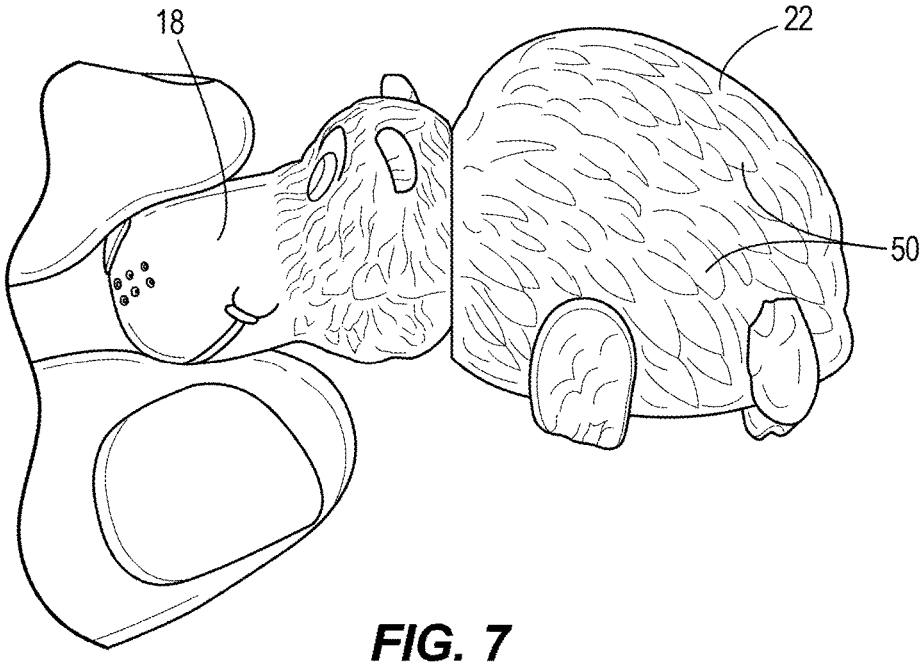
Figure 8A:
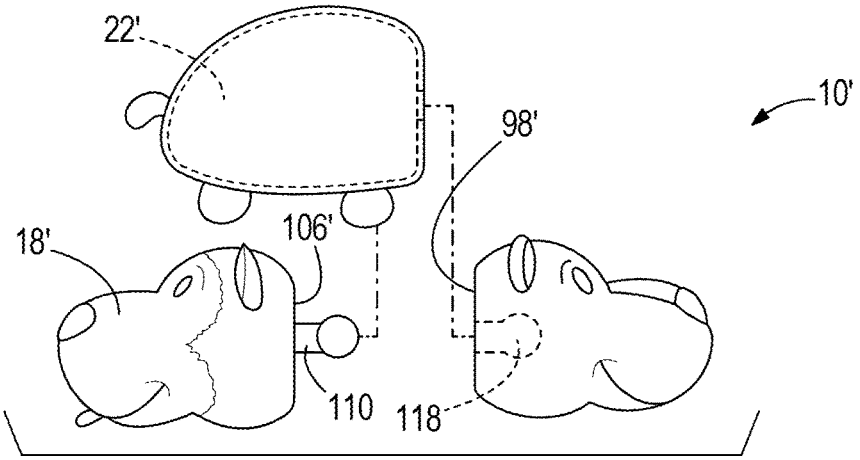
FIG. 8A is a side exploded view of another embodiment of a toy embodying the present invention.
Figure 8B:
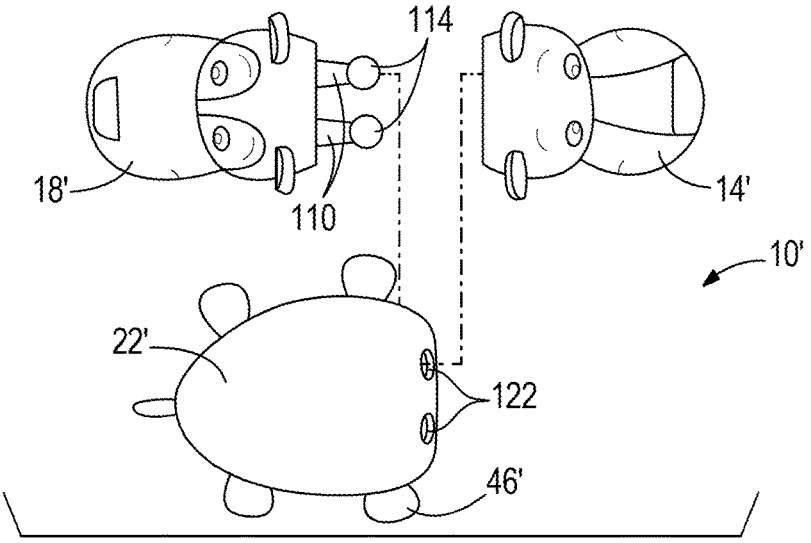
FIG. 8B is a top exploded view of the toy of FIG. 8A.
Figure 8C:
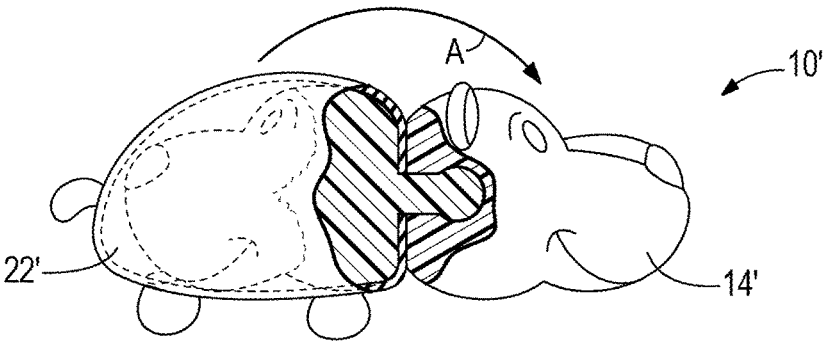
FIG. 8C is a side view, partially cut away, of the assembled toy of FIGS. 8A and 8B.

The flap 22 is movable from a first position (see FIG. 1), in which the flap covers the second head 18, with the first head 14 exposed to view, to a second position (see FIGS. 2 and 3), in which the flap 22 covers the first head 14, with the second head 18 exposed to view. FIGS. 5-7 sequentially illustrate the movement of the flap 22 from the first position (see FIG. 5) to the second position (see FIG. 7) in another embodiment of the toy 10 representing two different creatures or characters. FIG. 8C also includes an arrow A representing the direction of movement from the first position to the second position (with the opposite direction being the movement from the second position to the first position). As shown in FIGS. 1-4, the first head 14 is representative of an elephant's head and the second head 18 is representative of a hippopotamus' head. However, in other embodiments, any other desirable character head or forms can be used. For example, FIGS. 5-7 illustrate the first head 14 as an alligator or crocodile head, and the second head 18 as a bear head. FIGS. 8A-C show yet another embodiment with the first head 14' as a bear head and the second head 18' as a dog or wolf head. The heads 14, 18, can include representations of eyes, noses, teeth, ears, hair, horns, trunks, and various other features of creature heads.

The flap 22 is a flexible member that in the illustrated embodiment is more flexible than the material used for the heads 14, 18. In the illustrated embodiment, the flap 22 can be made of thermoplastic rubber (TPR), fabric, or other suitable flexible materials. The flexible flap 22 is generally dome-shaped when in the first position to cover the second head 18, and is generally dome-shaped when in the second position to cover the first head 14 (see FIG. 3). In other words, the flap 22 is reversible and is shaped to define a cavity 26 (see FIG. 3) sized to receive either one of the heads 14, 18. Where the flap 22 is made of TPR, the dome shaping of the flap 22 can be the molded natural state to which the flap 22 wants to return, in both reversible positions. Thus, the flap 22 may actually snap between the two dome-shaped states, making operation easy for children. In other words, the TPR flap can act somewhat like an over-center mechanism when being moved between the first and second positions. This can be seen in FIGS. 5-7.

The flexible flap 22 has an outer surface 30 when in the first position that, in the illustrated embodiment, has a same color as the first head 14, and has an outer surface 34 when in the second position that, in the illustrated embodiment, has a same color as the second head 18. In this manner, the toy 10 clearly represents a single creature or character in the first configuration, and clearly represents a different single creature or character in the second configuration. One or both outer surfaces 30, 34 of the flap 22 can be painted or otherwise coated to achieve the desired colors. In the illustrated embodiment, the flap is molded from a TPR material of one desired color, and one of the outer surfaces 30, 34 is painted/coated with the other desired color. In other embodiments, patterns, in addition to or as an alternative to colors, could be used to coordinate the head to the respective outer surface of the flap 22.

Figure 2:
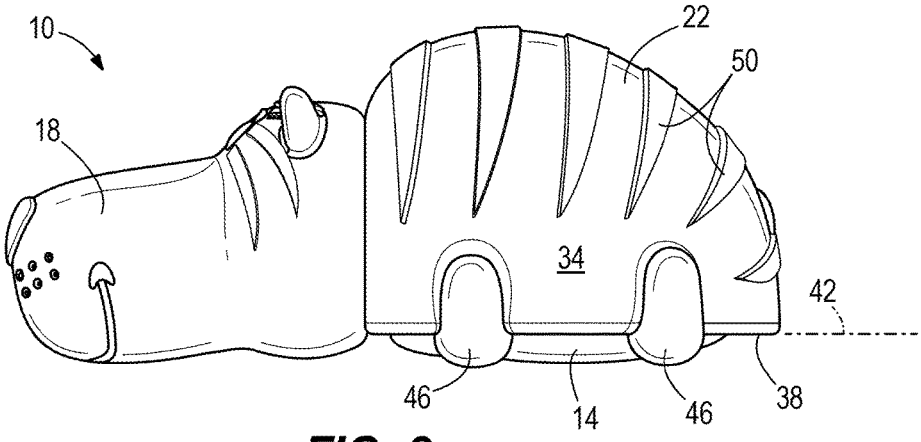
FIG. 2 is a side view of the toy of FIG. 1 in a second configuration.
Figure 3:
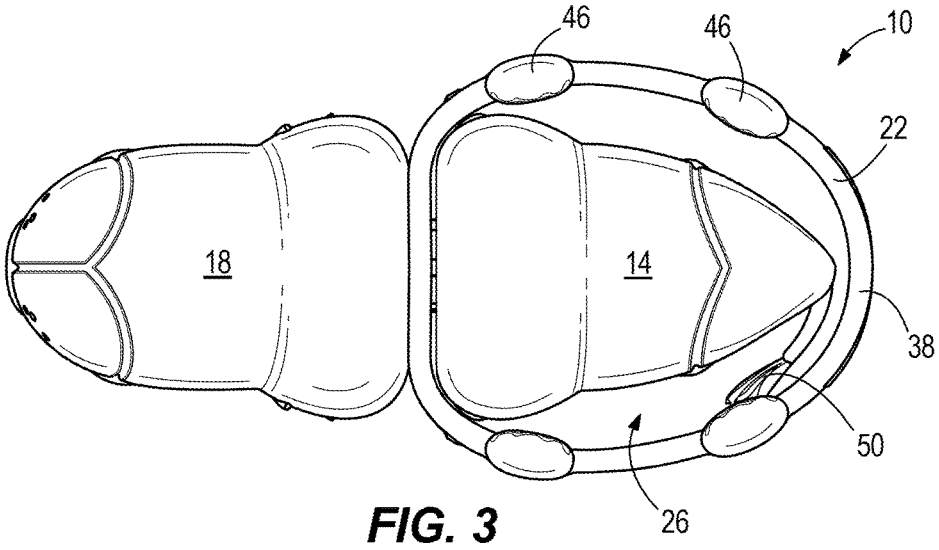
FIG. 3 is a bottom view of the toy in the second configuration of FIG. 2.

With reference to FIGS. 1 and 2, the flexible flap 22 further includes a lower edge 38 lying in a plane 42. At least one extension portion 46 extends beyond the plane 42 to represent an appendage of an animal or character represented by the toy 10. The extension portion can represent a foot, a tail, a wing, a fin or any other suitable appendage of a character represented by the toy 10. In the embodiment shown in FIGS. 1 and 2, the extension portions 46 represent feet. Additionally, the flexible flap 22 can be textured on at least one of the outer surfaces 30 and 34 to represent the features of the creature or character represented. The texturing can be created by the molding process, or can be created by additional members connected to the flap 22. For example, FIG. 2 illustrates texturing 50 in the form of ridges along the back of the hippopotamus. In FIG. 3, texturing 50 in the form of an elephant's tail can be seen. In FIG. 5, the outer surface 30 has texturing 50 in the form of spines of the crocodile or alligator. In FIG. 7, the outer surface 34 has texturing 50 in the form of the fur of the bear. One skilled in the art will understand how different creatures or characters can be accurately represented using different coloring and/or texturing options on the opposing outer surfaces 30, 34.

Figure 4:
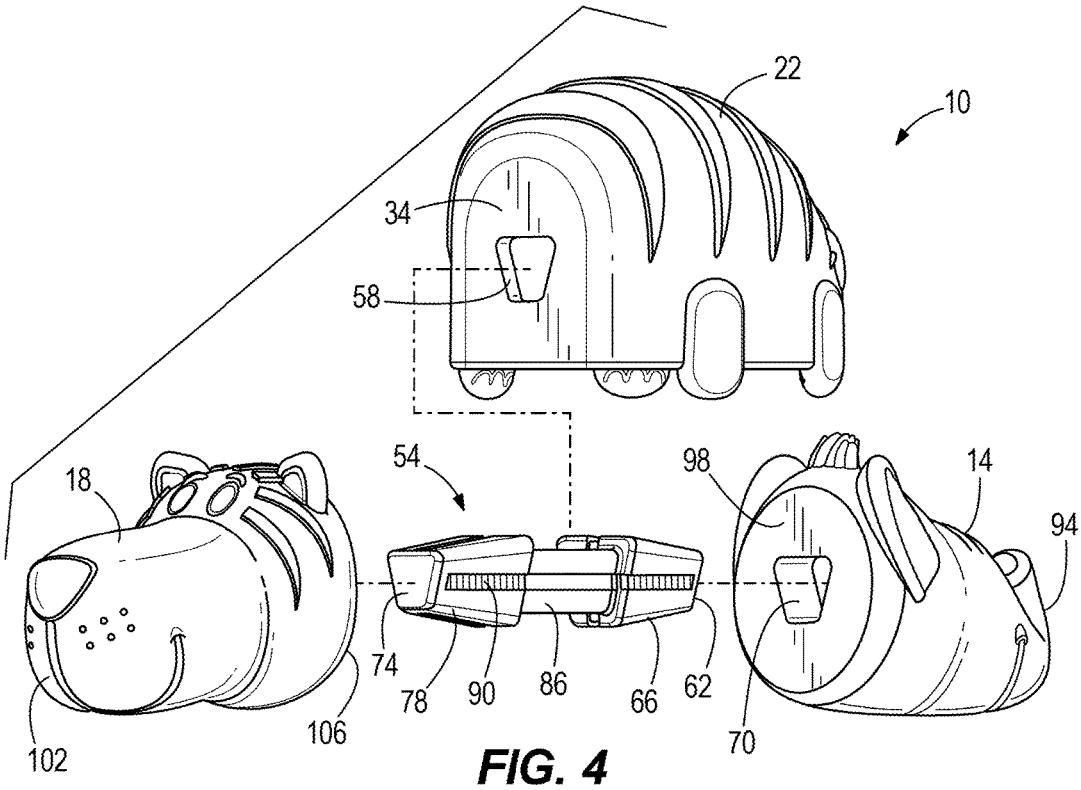
FIG. 4 is an exploded view of the toy of FIG. 1.

Referring now to FIG. 4, the toy 10 is assembled together via a post 54 that couples the first and second heads 14, 18 together. In the illustrated embodiment, the post 54 also couples the flexible flap 22 to the first and second heads 14, 18. Specifically, the flap 22 includes an aperture 58 through which the post 54 can pass or extend in order to secure the flap 22 to the assembled toy 10. In other embodiments, the flap 22 can be secured between the heads 14, 18 in different manners. The post 54 has a first end 62 with a first engagement member 66 sized and configured to be received in a correspondingly-shaped opening 70 in the first head 14. The post 54 also has a second end 74 with a second engagement member 78 sized and configured to be received in a correspondingly-shaped opening (not shown—but identical in shape, size, and location to the opening 70) in the second head 18 to thereby couple the first and second heads 14, 18 together.

In the embodiment illustrated in FIG. 4, each of the first and second engagement members 66 and 78 tapers from a larger dimension at a location closer to a mid-section 86 of the post 54 to a smaller dimension at a location closer to the respective first and second ends 62, 74. In the illustrated embodiment, each of the engagement members 66, 78 and the mid-section 86 of the post 54 are generally trapezoidally-shaped in cross-section. The openings 70 in the heads 14, 18, and the aperture 58 in the flap 22 are also generally trapezoidally-shaped. In this manner, the components of the toy 10, when assembled, will be prevented from rotating relative to one another about an axis extending longitudinally through the post 54. This will prevent the first and second heads 14, 18 from becoming misaligned rotationally relative to one another, and will further help prevent the flap 22 from rotating about the post 54 in a manner that would make moving the flap 22 between the first and second positions difficult.

In one embodiment, the engagement between the first engagement member 66 and the opening 70 in the first head 14, and the engagement between the second engagement member 78 and the opening in the second head 18, are both snap-fit engagements, such that once engaged, any disengagement will cause at least one of the post 54 or the first or second heads 14, 18 to break. In this manner, once assembled, the toy 10 is not able to be disassembled without partially destroying the toy 10. A groove 90 can be provided to extend axially along much of the length of the post 54, along one or more sides of the post 54. This groove 90 can assist with allowing some deformation of the post 54 to achieve the snap-fit into the openings 70 in the heads 14, 18. The post 54 can be made of a rigid material, such as the same materials used for the heads 14, 18. In other embodiments, other engagement arrangements could be used to permit repeated assembly and disassembly of the toy 10.

Assembly of the toy 10 can occur by pressing the first end 62 of the post 54 into the opening 70 in the first head 14 until it snaps into place. Then the flap 22 can be positioned onto the second end 74 and moved to the mid-section 86 of the post. The aperture 58 in the flap 22 may need to be stretched to pass over the second engagement member 78. Finally, the second end 74 of the post 54 can be pressed into the second head 18 until it snaps into place, thereby sandwiching the flap 22 between the heads 14, 18. More specifically, once assembled, the first head 14 has a distal end 94 and proximal end 98, and the second head 18 has a distal end 102 and a proximal end 106. The openings 70 in the heads 14, 18 have a predetermined depth to enable the snap fit, yet also allow sufficient axial space between the heads 14, 18 for the flap 22 to be sandwiched therebetween. The flexible flap 22 is sandwiched between the proximal ends 98, 106 of the first and second heads 14, 18 so that a first surface (the outer surface 30) of the flexible flap 22 touches the proximal end 98 of the first head 14 and a second surface (the outer surface 34) of the flexible flap 22 touches the proximal end 106 of the second head 18. In the illustrated embodiment, the flexible flap 22 is compressed between the respective proximal ends 98, 106. By having this tight, sandwiched fit, wear and tear on the flap 22 is minimized over the course of the many anticipated movements between the first and second positions. Additionally, the TPR material around the perimeter of the aperture 58 can be thicker than the rest of the flap 22 to further minimize the likelihood of tearing the flap 22 in the vicinity of the aperture 58.

FIGS. 8A-8C illustrate a slightly different embodiment of the toy 10', with like parts designated with like reference numbers followed by the prime symbol ('). Only the differences will be discussed below. With the toy 10', the flap 22' is made of fabric instead of TPR. The fabric can be chosen for toughness and durability, but will still be more flexible than the rigid heads 14', 18'. Furthermore, the toy 10' utilizes a different interconnection method. Specifically, two pins 110 are integrally formed (e.g., molded) with the second head 18' to extend from the proximal end 106'. The pins 110 are spaced-apart laterally and each includes a generally spherical engagement end 114. Two corresponding recesses 118 (only one is shown) are formed (e.g., molded) into the proximal end 98' of the first head 14' to receive the pins 110 in a snap-fit engagement. The flap 22' has two apertures 122 sized and spaced to receive the pins 110 therethrough. In this embodiment, the use of two pins 110, two recesses 118 and two apertures 122 operates to anti-rotate the parts relative to one another. Once again, the snap-fit arrangement can be permanent (i.e., requiring destruction to disassemble), or can be made non-permanent to allow interchangeability.

Various features and advantages of the invention are set forth in the following claims.

What is claimed is:

1. A toy comprising:

a first creature head of a rigid material;

a second creature head different from the first creature head and of a rigid material wherein the second creature head is coupled to the first creature head and faces in an opposite direction to the first creature head; and a flexible flap having a first surface representing a portion of a first body that corresponds to the first creature head and a second surface opposite the first surface representing a portion of a second body that is different from the first body and corresponds to the second creature head, wherein the flexible flap is inserted between the first and second creature heads and movable from a first position, in which the flexible flap covers the second creature head with the first creature head and first surface exposed to view, to a second position, in which the flexible flap covers the first creature head with the second creature head and second surface exposed to view; a post that couples the first and second creature heads together.

2. The toy of claim 1, wherein the flexible flap includes an aperture, and wherein the post extends through the aperture.

3. The toy of claim 1, wherein the post has a first end with a first engagement member sized and configured to be received in a correspondingly-shaped opening in the first creature head, and a second end with a second engagement member sized and configured to be received in a correspondingly-shaped opening in the second creature head to thereby couple the first and second creature heads together.

4. The toy of claim 3, wherein the flexible flap includes an aperture, and wherein the post extends through the aperture.

5. The toy of claim 3, wherein each of the first and second engagement members taper from a larger dimension, at a location adjacent to a mid-section of the post, to a smaller dimension, at a location adjacent to the respective first and second ends.

6. The toy of claim 3, wherein the engagement between the first engagement member and the opening in the first creature head, and the engagement between the second engagement member and the opening in the second creature head, are both snap-fit engagements, such that once engaged, any disengagement will cause at least one of the post or the first or second creature heads to break.

7. The toy of claim 1, wherein the flexible flap is made of thermoplastic rubber.

8. The toy of claim 1, wherein the flexible flap is made of fabric.

9. The toy of claim 1, wherein the flexible flap is generally dome-shaped when in the first position to cover the second creature head, and is generally dome-shaped when in the second position to cover the first creature head.

10. The toy of claim 1, wherein the first surface of the flexible flap has a same color as the first creature head, and wherein the second surface of the flexible flap has a same color as the second creature head.

11. The toy of claim 1, wherein the flexible flap includes a lower edge lying in a plane and at least one extension portion that extends beyond the plane to represent an appendage of a creature represented by the toy.

12. The toy of claim 11, wherein the extension portion represents one of a foot, or a tail, or a wing, or a fin of a creature represented by the toy.

13. The toy of claim 1, wherein the flexible flap is textured on at least one surface.

14. The toy of claim 1, wherein the first creature head has a distal end and proximal end, and the second creature head has a distal end and a proximal end, the flexible flap sandwiched between the proximal ends of the first and second creature heads so that a first surface of the flexible flap touches the proximal end of the first creature head and a second surface of the flexible flap touches the proximal end of the second creature head.

15. The toy of claim 14, wherein the flexible flap is compressed between the respective proximal ends.

16. A toy comprising:

a first head of a rigid material;

a second head different from the first head and of a rigid material, wherein the second head is coupled to the first head and faces in an opposite direction to the first head;

a flexible flap sandwiched between the first and second heads, the flexible flap having a first surface representing a portion of a first body that corresponds to the first head and a second surface opposite the first surface representing a portion of a second body that is different from the first body and corresponds to the second head, wherein the flexible flap is movable from a first position, in which the flap covers the second head with the first head and first surface exposed to view, to a second position, in which the flap covers the first head with the second head and second surface exposed to view, and wherein the flexible flap is configured to define a dome-shaped cavity independently of the first and second heads when in the first and second positions; and a post that couples the first and second heads together;

wherein the flexible flap includes an aperture, and wherein the post extends through the aperture.

17. The toy of claim 16, wherein the flexible flap has a thickened area around a perimeter of the aperture.

18. The toy of claim 16, wherein the first head has a distal end and proximal end, and the second head has a distal end and a proximal end, the flexible flap sandwiched between the proximal ends of the first and second heads so that the first surface of the flexible flap touches the proximal end of the first head and the second surface of the flexible flap touches the proximal end of the second head, the flexible flap being compressed between the respective proximal ends.

19. The toy of claim 16, wherein the post has a first end with a first engagement member sized and configured to be received in a correspondingly-shaped opening in the first head, and a second end with a second engagement member sized and configured to be received in a correspondingly-shaped opening in the second head to thereby couple the first and second heads together;

wherein each of the first and second engagement members taper from a larger dimension, at a location closer to a mid-section of the post, to a smaller dimension, at a location closer to the respective first and second ends.

* * * * *